US008973904B2

(12) United States Patent
McCann et al.

(10) Patent No.: US 8,973,904 B2
(45) Date of Patent: Mar. 10, 2015

(54) FENCE ASSEMBLY

(71) Applicants: William P McCann, Leander, TX (US); Michael J. McCann, Leander, TX (US)

(72) Inventors: William P McCann, Leander, TX (US); Michael J. McCann, Leander, TX (US)

( * ) Notice: Subject to any disclaimer, the term of this patent is extended or adjusted under 35 U.S.C. 154(b) by 2 days.

(21) Appl. No.: 13/796,203

(22) Filed: Mar. 12, 2013

(65) Prior Publication Data

US 2014/0264219 A1 Sep. 18, 2014

(51) Int. Cl.
*E04H 17/14* (2006.01)

(52) U.S. Cl.
CPC ..... *E04H 17/1421* (2013.01)
USPC ..... 256/65.08; 256/22

(58) Field of Classification Search
CPC ..... E04H 17/1417; E04H 17/1426; E04H 17/143; E04H 17/1421; E04H 17/1434; E04H 2017/146
USPC ..... 256/22, 59, 65.01, 65.02, 65.04, 65.05, 256/65.06, DIG. 4
See application file for complete search history.

(56) References Cited

U.S. PATENT DOCUMENTS

| | | | | | |
|---|---|---|---|---|---|
| 210,526 | A | | 12/1878 | Hanson | |
| 250,547 | A | | 12/1881 | Kirby | |
| 353,281 | A | | 11/1886 | Anderson | |
| 386,567 | A | | 7/1888 | Vanderhoof | |
| 480,166 | A | | 8/1892 | Bettersby | |
| 1,164,643 | A | * | 12/1915 | Hale | 52/506.06 |
| 1,376,150 | A | | 4/1921 | Miller | |
| 2,327,311 | A | | 8/1943 | Lundy | |
| 2,607,563 | A | | 8/1952 | Rochester | |
| 2,773,674 | A | | 12/1956 | Fischer et al. | |
| 2,863,642 | A | * | 12/1958 | Pagett | 256/22 |
| 3,082,993 | A | | 3/1963 | Loudon | |
| 3,212,754 | A | | 10/1965 | Revell et al. | |
| 3,397,866 | A | | 8/1968 | Hockett | |
| 3,920,221 | A | | 11/1975 | Berry et al. | |
| 3,960,367 | A | * | 6/1976 | Rogers | 256/21 |
| 4,198,034 | A | * | 4/1980 | Svirklys | 256/72 |
| 4,477,058 | A | | 10/1984 | Lowery | |
| 4,899,989 | A | | 2/1990 | Kitson et al. | |
| 5,046,705 | A | | 9/1991 | Williams | |
| 5,110,094 | A | * | 5/1992 | Kruse | 256/47 |
| 5,190,268 | A | | 3/1993 | Espinueva | |
| 5,458,319 | A | | 10/1995 | Mackay | |
| 5,529,289 | A | | 6/1996 | Lancer, Sr. | |

(Continued)

FOREIGN PATENT DOCUMENTS

| | | | | |
|---|---|---|---|---|
| DE | 4039657 A1 | * | 6/1992 | F16B 7/08 |
| EP | 2336459 B1 | * | 8/2012 | |

(Continued)

*Primary Examiner* — Joshua Kennedy
(74) *Attorney, Agent, or Firm* — Flaster/Greenberg P.C.

(57) ABSTRACT

A fence assembly is provided having a plurality of posts, a plurality of elongated rails, with each rail having a hollow interior and a front face including an elongated channel extending into the hollow interior, a plurality of fence slats, and a plurality of brackets, with each bracket formed to retain at least one fence slat. The brackets include engagement ends positioned on an extension member formed on the bracket body. The engagement ends are inserted into the channel and the interior hollow of the rails to secure the brackets to the rails. The brackets are secured to the rail and create a retaining slot for receiving at least one fence slat and to support the fence slat on the rail. The rail is attached to one or more posts to form, along with the plurality of brackets and fence slats, a fencing section.

16 Claims, 14 Drawing Sheets

(56) References Cited

U.S. PATENT DOCUMENTS

| | | | | |
|---|---|---|---|---|
| 5,628,494 | A * | 5/1997 | Arnold | 256/24 |
| 5,628,495 | A | 5/1997 | Gandara | |
| 5,657,967 | A | 8/1997 | Patrick | |
| 5,695,174 | A * | 12/1997 | Tsai | 256/22 |
| 5,702,090 | A | 12/1997 | Edgman | |
| 5,921,530 | A | 7/1999 | Joyce et al. | |
| 6,344,617 | B1 | 2/2002 | Berto | |
| 6,345,809 | B1 * | 2/2002 | Bebendorf | 256/24 |
| 6,585,234 | B2 | 7/2003 | Berto | |
| 6,708,955 | B2 | 3/2004 | Cummings | |
| 6,755,394 | B2 | 6/2004 | Forbis et al. | |
| 6,772,998 | B2 * | 8/2004 | Bebendorf | 256/24 |
| 6,902,152 | B1 | 6/2005 | Clifford et al. | |
| 6,913,249 | B1 | 7/2005 | Lerdu | |
| 7,040,605 | B2 | 5/2006 | Lappen | |
| 7,503,551 | B2 | 3/2009 | Auret | |
| 7,523,921 | B2 | 4/2009 | Garrity | |
| 7,654,473 | B2 | 2/2010 | Hibberd | |
| 7,740,233 | B1 | 6/2010 | Larsen | |
| 7,789,376 | B2 | 9/2010 | Diamond et al. | |
| 8,177,195 | B2 * | 5/2012 | Schall et al. | 256/22 |
| 2002/0020834 | A1 | 2/2002 | Stusser | |
| 2002/0190248 | A1 * | 12/2002 | Ohai | 256/64 |
| 2004/0140461 | A1 | 7/2004 | Lappen | |
| 2006/0081828 | A1 | 4/2006 | Gidseg | |
| 2006/0145132 | A1 * | 7/2006 | Boehmke | 256/24 |
| 2006/0226407 | A1 | 10/2006 | Auret | |
| 2012/0138758 | A1 | 6/2012 | Graber | |
| 2014/0021425 | A1 * | 1/2014 | Van Es | 256/65.03 |

FOREIGN PATENT DOCUMENTS

| | | | |
|---|---|---|---|
| FR | 2450410 | A1 * | 3/1979 |
| FR | 2555639 | A1 | 5/1985 |
| GB | 2094368 | A | 9/1982 |

* cited by examiner

FENCE ASSEMBLY

FIELD OF THE INVENTION

The present disclosure relates to a fence assembly having a number of constituent parts.

BACKGROUND OF THE INVENTION

Fence structures have been used for years to define boundaries, provide security, to create privacy, etc. In addition, fence structures are sometimes required for safety reasons, such as to surround a swimming pool.

Various structures are known to form a fence assembly. These structures may be formed from any number of materials, including metal, wood and plastic. The known fence structures often provided features that assist in assembly and disassembly, that facilitate security or privacy, and that provide desired aesthetics.

The present disclosure relates to a fence assembly having various advantages over many of the known structures.

SUMMARY OF THE INVENTION

One aspect of the present invention is a fence assembly having as constituent parts a plurality of brackets that engage with a channeled support bar. The support bar is secured to posts for securing the assembly and the brackets retain one or more fence slats. The retaining brackets are slidably engaged to the support bar. Preferably the support bar is provided with a "C" shaped channel provided along the length of the bar. The opening in the channel is positioned towards the desired position of the fence slats in the final assembly. The retaining brackets are generally "U" shaped and include a retaining tab on each of the projected ends. The retaining tabs are positioned within the channel on the support bar. In one embodiment, the brackets are slid into the channel from one end of the bar and positioned along the length of the bar. Multiple brackets are slid into the channel and are positioned adjacent one another. The fence slats are fit behind the brackets and supported from the rear by the support bar. The two ends of the support bar may be attached to a vertical post to form a fence section. Each fence section will typically include at least two support bars, positioned parallel to one another, with the brackets aligned to retain the fence slats in a desired position. The ends of the adjacent support bars/fence sections may be attached to one another to form a stable fence assembly.

In a further aspect of the disclosed fence assembly, a plurality of posts is provided along with a plurality of elongated rails. Each of the rails preferably includes a hollow interior and a front face having an elongated channel extending into the hollow interior. A plurality of fence slats and a plurality of brackets are also provided, with each bracket formed to retain at least one fence slat. The brackets include engagement ends positioned on an extension member on the bracket body. The engagement ends are inserted into the channel and the interior hollow of the rails to secure the brackets to the rails. The brackets are secured to the rail and create a retaining slot for receiving at least one fence slat and to support the fence slat on the rail. The rail is attached to one or more posts to form, along with the plurality of brackets and fence slats, a fencing section.

In various aspects of the fencing assembly, the retaining brackets may include different forms of engagement structures for attachment of the brackets to a rail. One form of engagement structure permits attachment of the bracket to the rail by sliding the bracket into the channel from one end of the rail, wherein the bracket cannot be removed from the channel (other than by sliding the bracket out of the channel). An alternate form of retaining bracket includes an engagement structure having engagement surfaces with sufficient clearance to permit the bracket to be pivoted into the channel from a position directly in front of the rail. The engagement surfaces may include an angled edge within the engagement tabs. The angle formation provided clearance during the pivoting engagement with the rail. Other bracket forms are contemplated to position the fence slats in a spaced or offset position along the rail.

In a further aspect of the present disclosure, fence assembly includes a plurality of posts and a plurality of elongated rails. Each rail being supported by one of the plurality of posts. The rails preferably having a hollow interior and defined by a back wall, a pair of opposing side walls, longitudinally extending from and along the longitudinal length of the back wall, and a pair of front face members. The front face members longitudinally extend along and project from a respective one of the side walls. The front face members are coplanar with each other and define a channel there between that extends into the hollow interior of the rail. A plurality of fence slats is provided, with each fence slat having a defined length, width and height. A plurality of brackets is also provided, with each bracket preferably including a planar body, a pair of opposing body extensions, longitudinally extending from the body, and engagement ends positioned on the body extensions. The engagement ends preferably form an engagement structure for insertion through the channel and into the hollow interior of the rails. The engagement structure is formed to secure the brackets to the front face members of the rails. The plurality of brackets are secured to at least one rail, with the extensions of the brackets spacing the body portion from the front face members to define a retaining slot having dimensions sufficient to receive at least one fence slat and to support the fence slat on the rail. The rail is attached to one or more posts to form, along with the plurality of brackets and fence slats, a fence section.

Other features of the present invention and combinations of features will become apparent from the detailed description to follow, taken in conjunction with the accompanying drawings.

BRIEF DESCRIPTION OF THE DRAWINGS

For the purpose of illustrating the invention, the drawings show one or more forms that are presently preferred. It should be understood that the invention is not limited to the precise arrangements and instrumentalities shown in the drawings.

DETAILED DESCRIPTION

Figure 1:
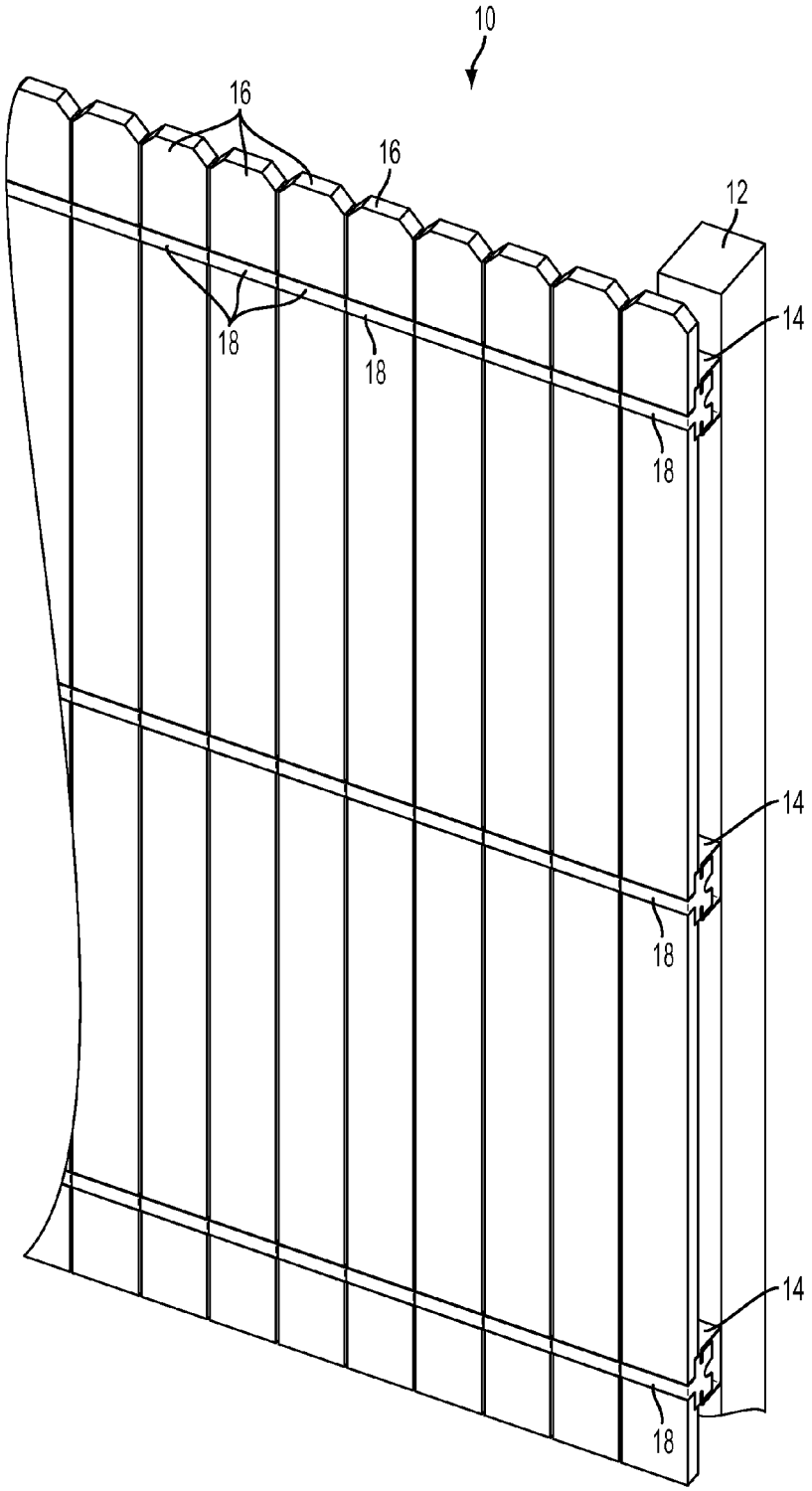
FIG. 1 shows a front isometric view of an embodiment of a fence assembly in accordance with the present disclosure.

In the figures, where like numerals identify like elements, there is shown an embodiment of a fence assembly, which is generally designated with the numeral 10. In FIG. 1, an embodiment of the fence assembly 10 is shown as including a post structure 12 (a plurality of posts being contemplated), a plurality of rails 14, a plurality of fence slats 16 and a corresponding plurality of retaining brackets 18. A portion of an assembled fence section including the listed elements is shown in FIG. 1.

Figure 2:
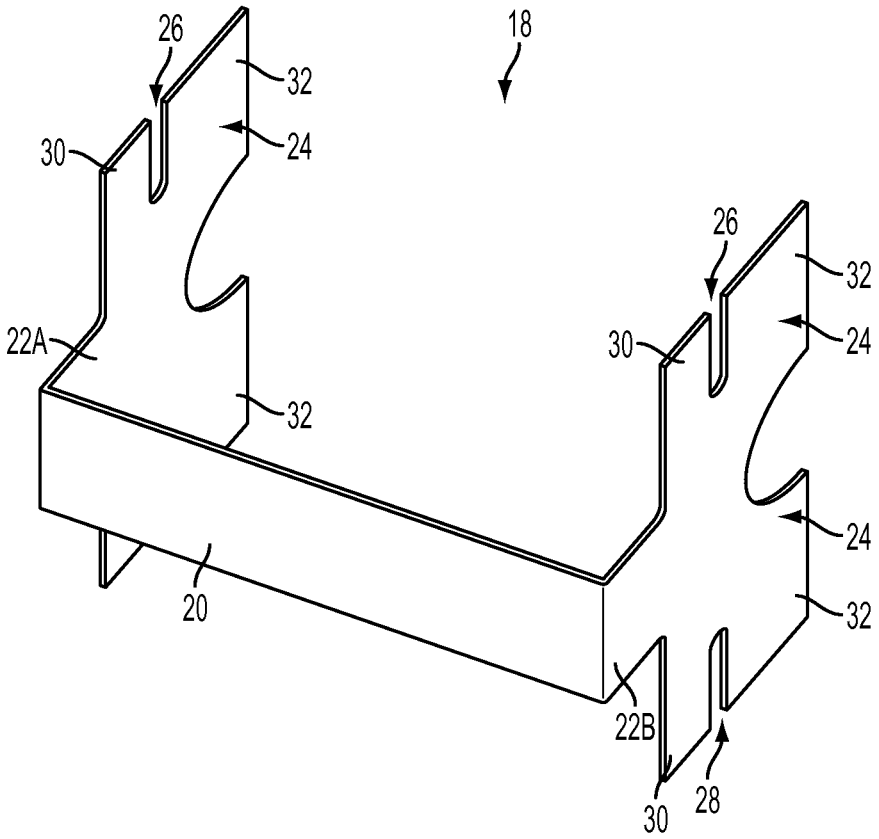
FIG. 2 shows an isometric view of a bracket portion of the fence assembly embodiment shown in FIG. 1.

In FIG. 2, there is shown a retaining bracket 18 of the type contemplated for use in the fence section of FIG. 1. The bracket 18 is generally U-shaped and includes a front or body portion 20 and a pair of opposing extensions or arms 22 (labeled A and B). On each of the projected ends of the extensions 22 is provided an engagement end 24 formed to secure the bracket 18 to the rails 14 (FIG. 1). The engagement end 24 of each extension 22 includes upper and lower retaining slots 26, 28 defined by front and rear tabs 30, 32.

Figure 3:
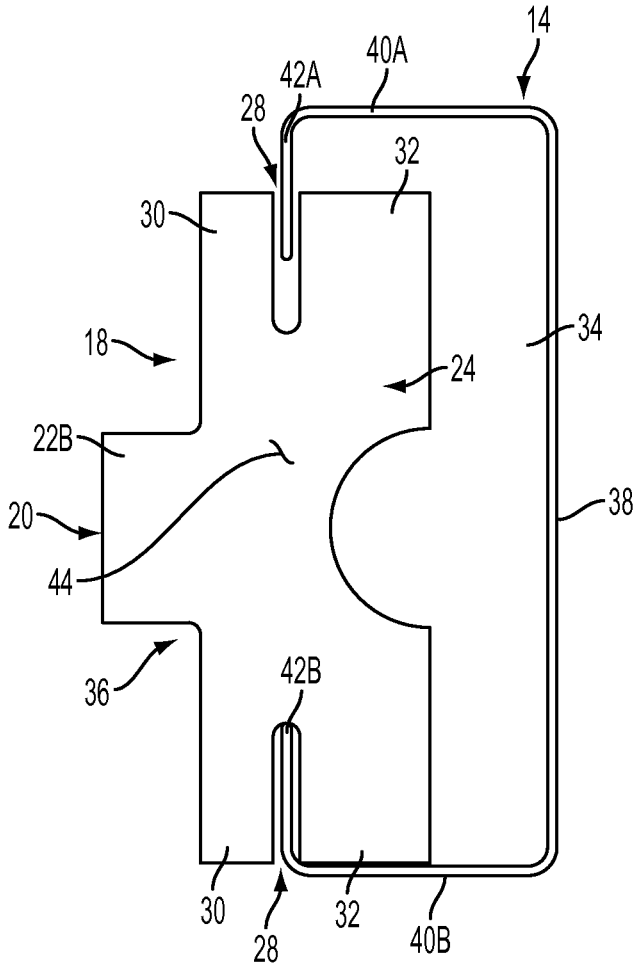
FIG. 3 shows an end view of an assembly of a bracket and channel structure of the fence embodiment shown in FIGS. 1 and 2.

In FIG. 3, there is shown the engagement of a bracket 18 with a rail 14. The rail structure 14 is contemplated to be elongated so as to support an extended fence section. The rail 14 is viewed in FIG. 3 from the end, which shows that the rail has a generally C-shaped profile with a hollow interior 34. The C-shaped rail structure is formed by a number of outside walls that surround the hollow 34 and that define a channel 36 providing an opening to the interior hollow 34. The rail 14 includes a back wall 38, a pair of opposing sidewalls 40 (labeled A and B), and a pair of front face members 42 (labeled A and B). One of the front face members 42A projects from sidewall 40A and the other front face member 42B projects from sidewall 40B, with the two members 42A, 42B being formed in the same plane and positioned on opposite sides of the channel 36.

The bracket 18 engages the elongated rail 14 by being slid into the channel 36 and hollow interior 34 of the rail from one of the rail ends. The brackets 18 are retained in position within the rail channel 36 by means of the retaining ends 24 formed on the bracket extensions 22. As shown in FIG. 3, the bracket 18 is retained on the rail 14 by positioning the front face members 42A, 42B within retaining slots 26, 28, respectively. The front tab 30 of each engagement end 24 engages the outside surface of the face members 42, with the rear tabs engaging the inside surface of the face member 42 within the interior 34 of the rail 14. A central portion 44 on the bracket 18 is positioned within the channel 36 formed between the front face members 42.

Figure 4:
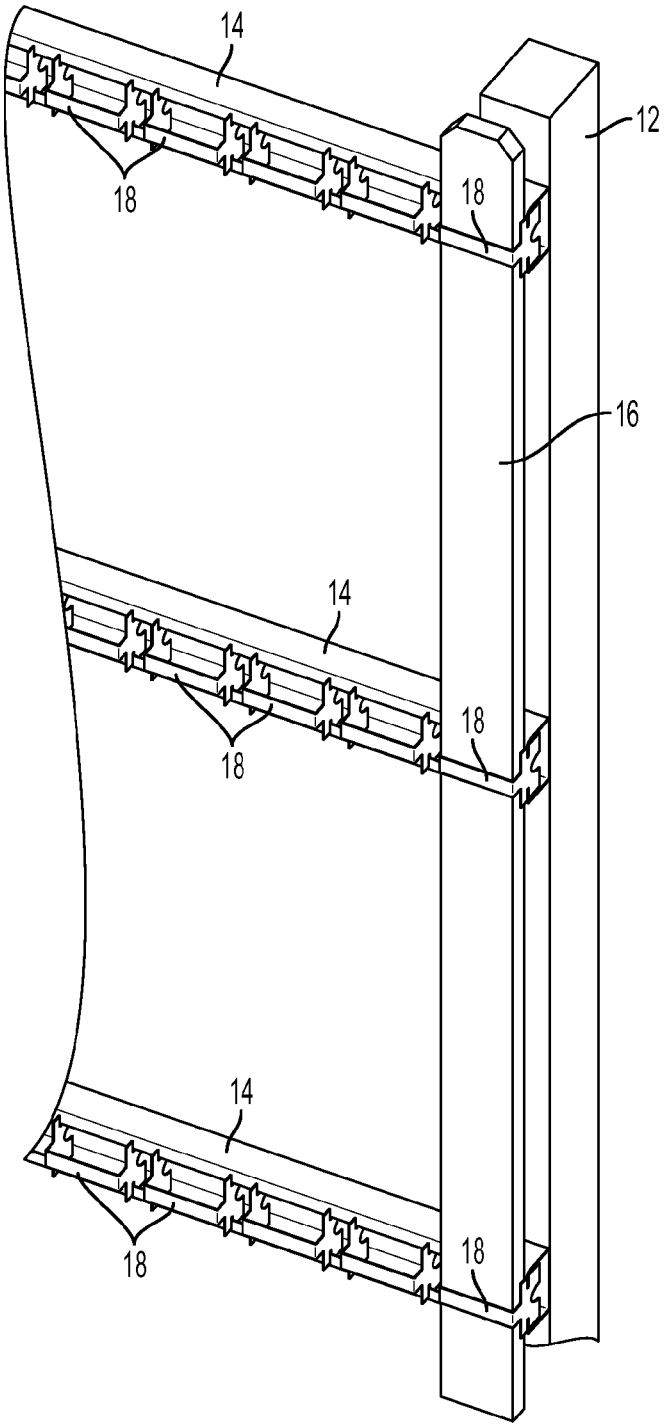
FIG. 4 shows an isometric view of a partial assembly of the fence embodiment of FIGS. 1-3.

The position of the engagement ends 24 of the bracket 18 within the channel 36 of the rail 14 secures the bracket 18 on the rail 14. The bracket 18 is contemplated to be slidable along the longitudinal length of the rail 14. As shown in FIG. 4, a plurality of brackets 18 may be secured to each rail 14 within the fence assembly 10. Each bracket 18 creates a retaining gap 46 formed between the body 20 and the front face members 42 of the rail 14. The width of the gap 46 is defined by the length of the bracket body 20 and the depth of the gap 46 is defined by the length of the extension 22. Preferably, the dimensions of the gap 46 defined by the bracket 18 conforms to the width and thickness of a fence slat 16.

Figure 5:
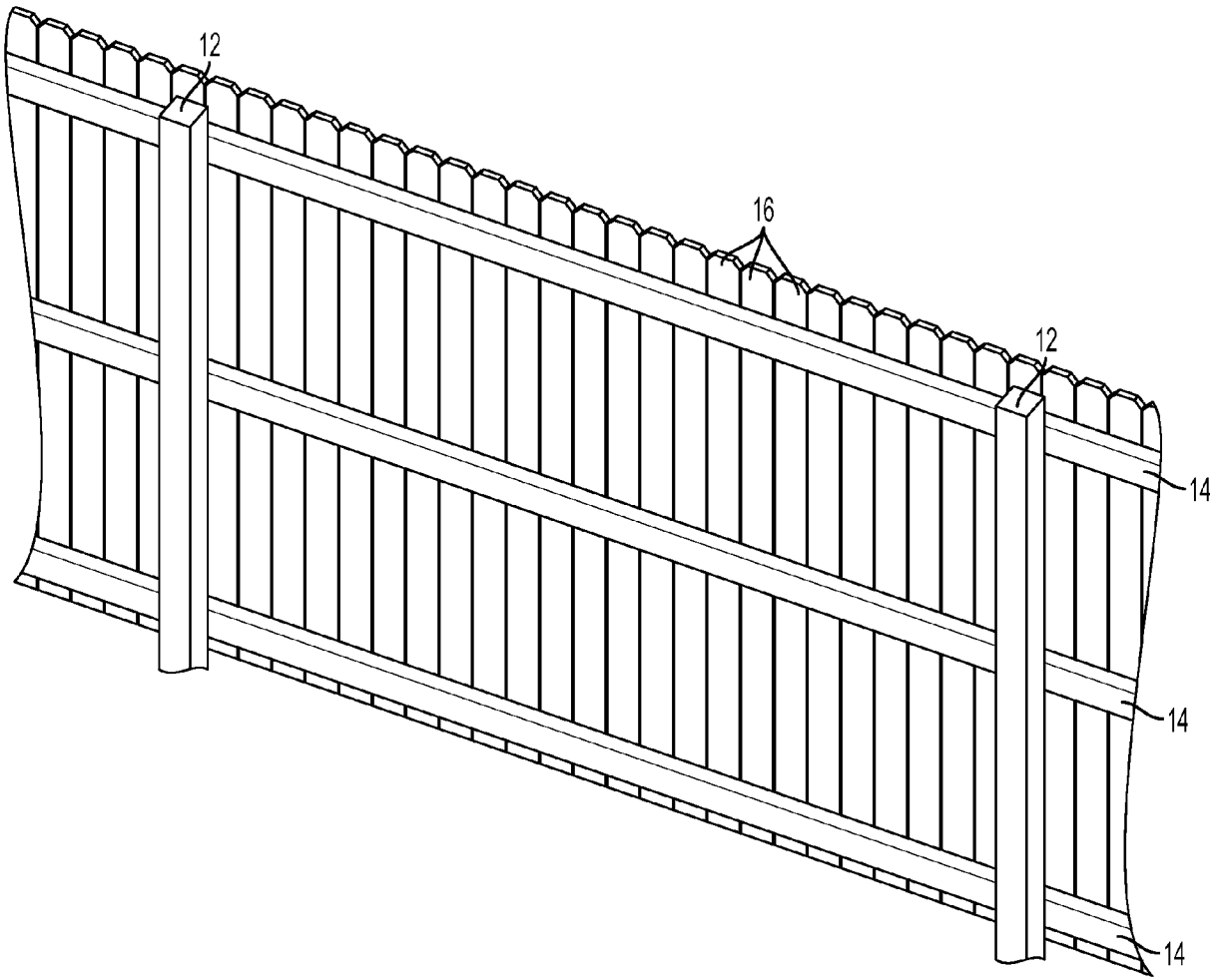
FIG. 5 shows a rear isometric view of the fence assembly embodiment of FIGS. 1-4.

As shown in FIG. 4, three spaced rails 14 are secured to a post 12 (with an opposing post preferably positioned at a spaced location along the rail) and are aligned in parallel. The open channel 36 of the rail is positioned outwardly from the mounting of the rail to post. A plurality of brackets 18 is slid onto the rail 14 and retained in the channel. The brackets 18 on each rail are preferably vertically aligned such that a fence slat 16 may be positioned within the slots 34 of the brackets 18. As shown in FIG. 1, a plurality of slats 16 is secured to the rails 14 by the aligned brackets 18. A rear view of the fence assembly 10 is shown in FIG. 5. The rails 14 are fixed to posts 12 and in turn support the fence slats 16. The rails 14 are shown between the posts 12 and the slats 16. The brackets (18) are not visible from the rear of the fence assembly.

Figure 6A:
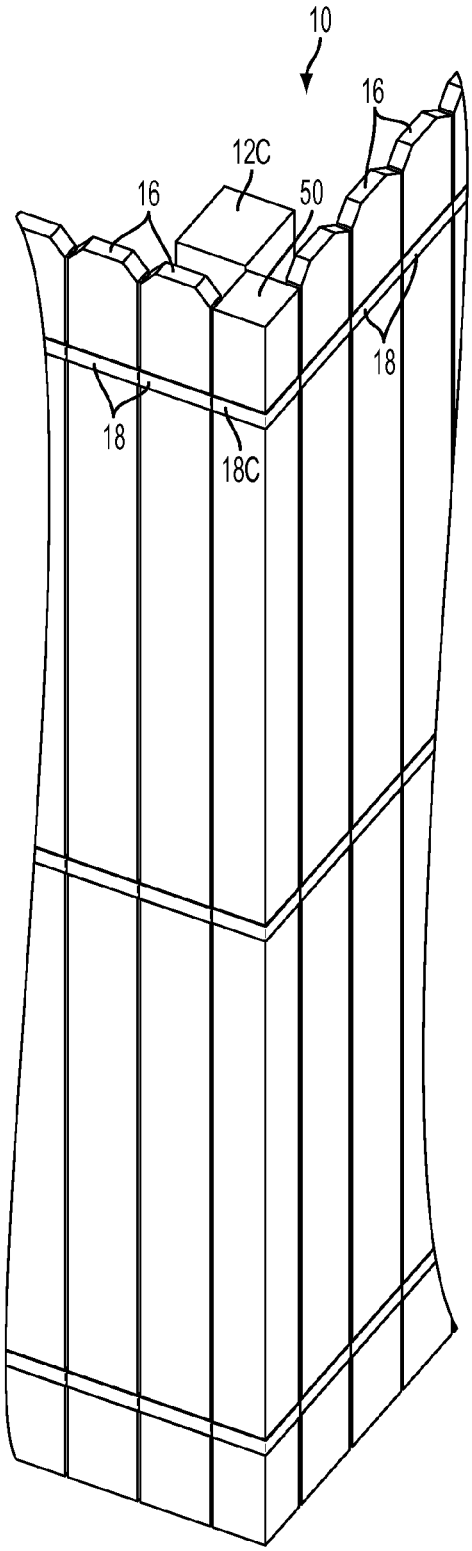
FIG. 6A shows a front isometric view of a corner portion of a fence assembly formed in accordance with the embodiment of FIGS. 1-5.
Figure 6B:
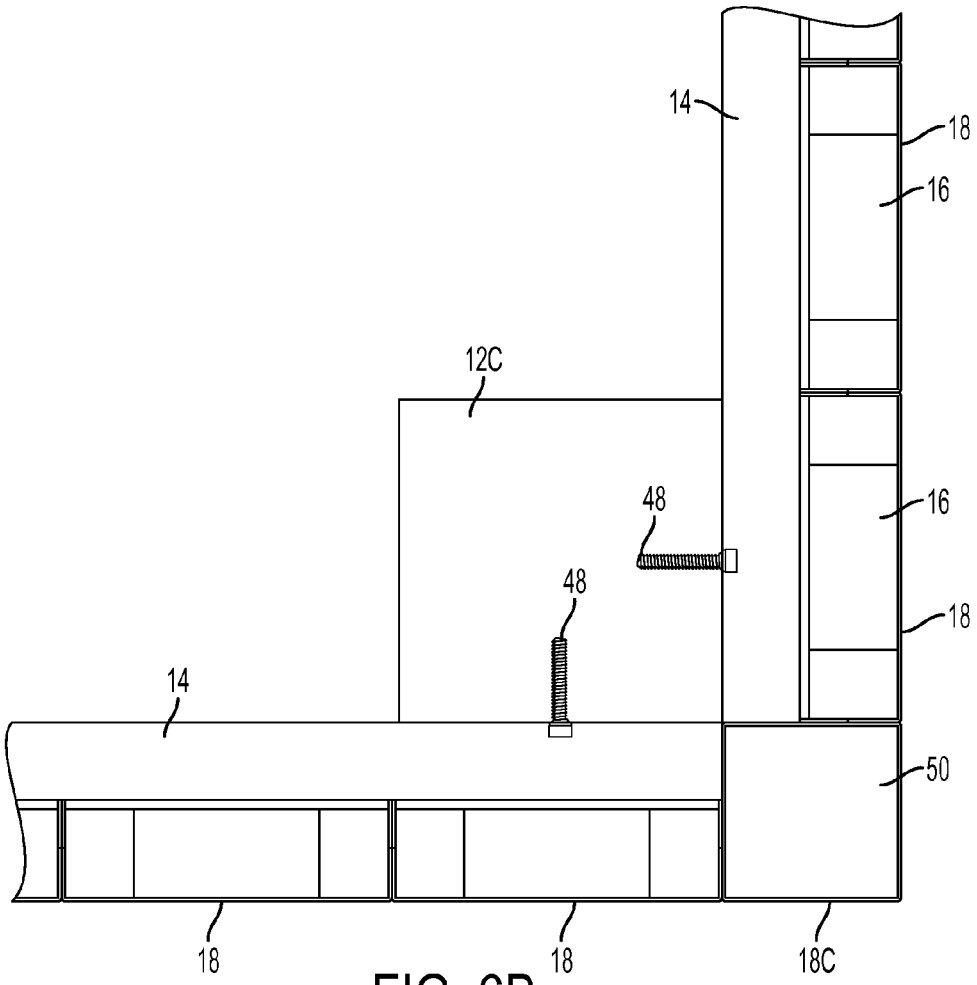
FIG. 6B shows a top view of the corner portion of the fence assembly of FIG. 6A.

The rails 14 preferably included a fixed length, although may be cut to conform to the dimensions of the fence assembly 10 to the desired dimensions of the area to be bound by the fence. Connecting structures (not shown) may be provided to fix abutting ends of adjacent rails in forming the assembly. Further, the rails 16 may be secured to the posts 12 in any convenient manner, such as screws, brackets, braces, etc. (not shown). As shown in FIGS. 6A and 6B, the fence assembly may include a corner that connects to fence sections at an angle. As shown, a post member 12C is provided inside of the assembly corner. In addition, a corner slat 50 is provided and is retained by a corner bracket 18C. The corner slat 50 includes dimensions that define the angle of the corner and blend the slats 16 with the corner transition. The corner brackets 18C surround the corner slat 50 and may provide extensions (not show) that permit the corner slat 50 to be secured to the corner post 12C and/or the adjacent ends of the rails. As shown in FIG. 6B, the rails are mounted by screws 48 that are directed through the back wall (38) of the rail 14 and into the post 12C. (A similar mounting of the rails to the other posts is also contemplated.) The posts 12 are shown as having a square transverse profile, but may have other forms, such being round, oval, triangular, etc.

Figure 7:
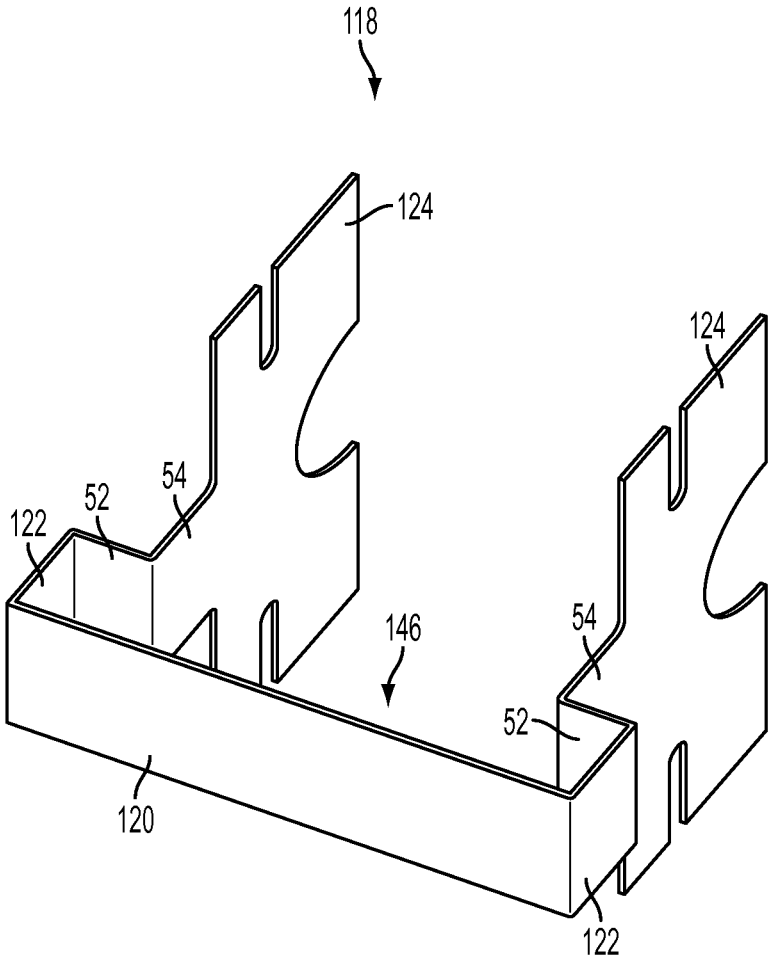
FIG. 7 shows an isometric view of an alternate embodiment of a bracket portion for a fence assembly in accordance with the present disclosure.
Figure 8:
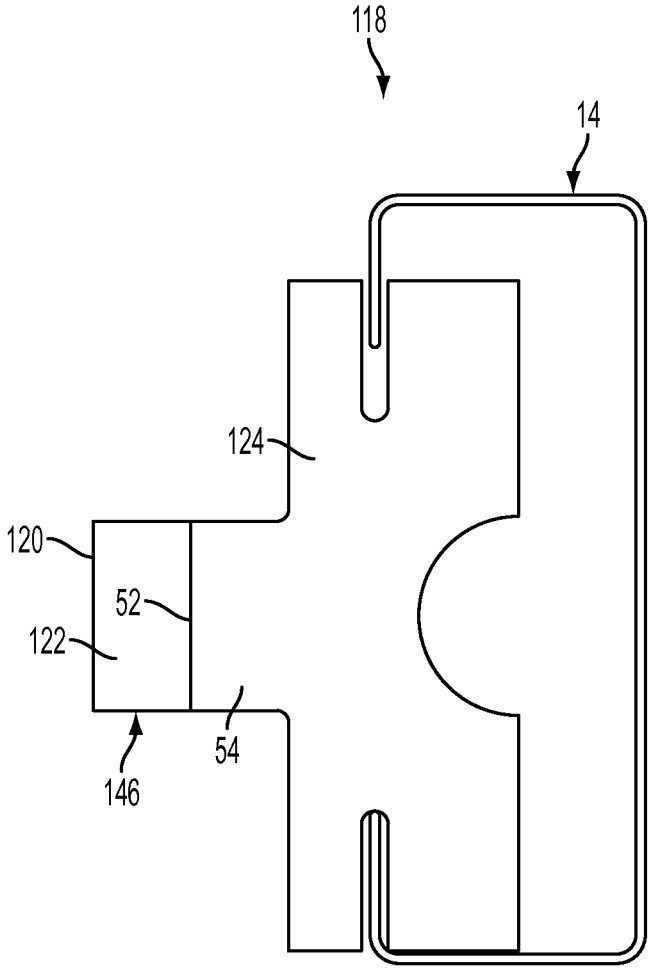
FIG. 8 shows an end view of the bracket portion of FIG. 7 and a channel structure in forming an alternate embodiment of a fence assembly.
Figure 9:
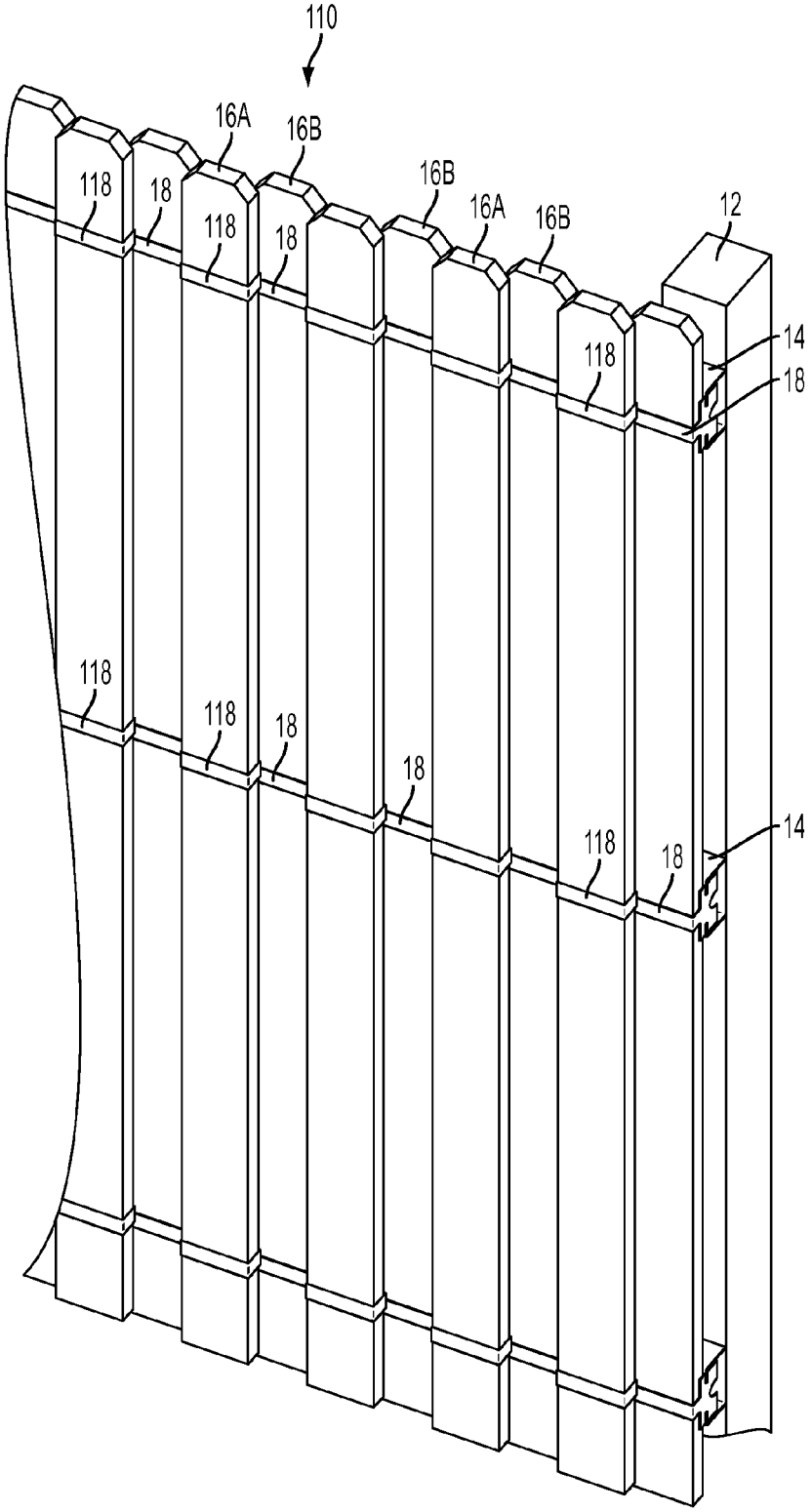
FIG. 9 shows a front isometric view of the embodiment of a fence assembly in accordance with structures of FIGS. 7-8.

In FIGS. 7-9, there is shown a further embodiment of a bracket as contemplated by the present disclosure for forming a fence assembly. In FIG. 7, there is shown an alternate bracket form 118. The bracket 118 includes a front or body portion 120, two opposing extensions or arms 122 and two engagement ends 124. The arms 122 connect to the engagement ends 124 by offset elements 52. The offset elements 52 connect to spacer tabs 54. As shown, the offset elements 52 are perpendicular to the arms 122, with the spacer tabs 54 perpendicular to the offset elements 52. The engagement structures of the engagement ends 124 are shown as being the same as those shown and described with respect to engagement ends 24 of bracket 18 of FIG. 2.

A slat retaining gap 146 is defined by the body 120, the arms 122 and the offset elements 52. As shown in FIG. 8, the retaining gap 146 is spaced by the spacer tabs 54 from the engagement between the engagement ends 124 and the rail 14. In FIG. 9, the brackets 118 are provided on a fence assembly 110 along with the brackets 18 of the form discussed above. The spacer tabs (54, FIGS. 7 and 8) on the bracket 118 position the fence slats 16A further away from the slats 16B that are retained by the brackets 18, which do not include a spacer. In FIG. 9, the two bracket forms 18, 118 are alternated along length of the rails 14 to provide a rising and falling or undulating fence surface. The offset elements (52, FIGS. 7 and 8) in the brackets 118 create an overlap of the outward fence slats 16A with the side edges of the inner fence slats 16B, which are retained by the alternate bracket structure 18. Further the length of the spacer tabs 54 may be set to provide a space between slats 16A, 16B at the overlapping edges, providing wind channels there between.

Figure 10:
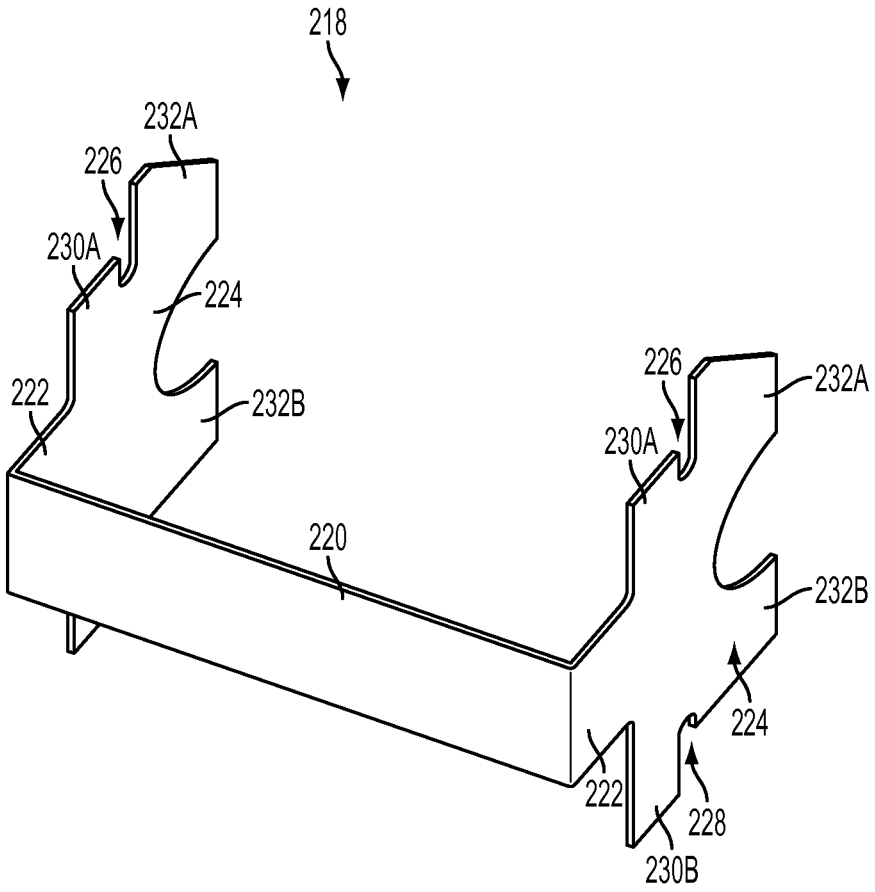
FIG. 10 shows an isometric view of a further embodiment of a bracket portion for a fence assembly in accordance with the present disclosure.
Figure 11:
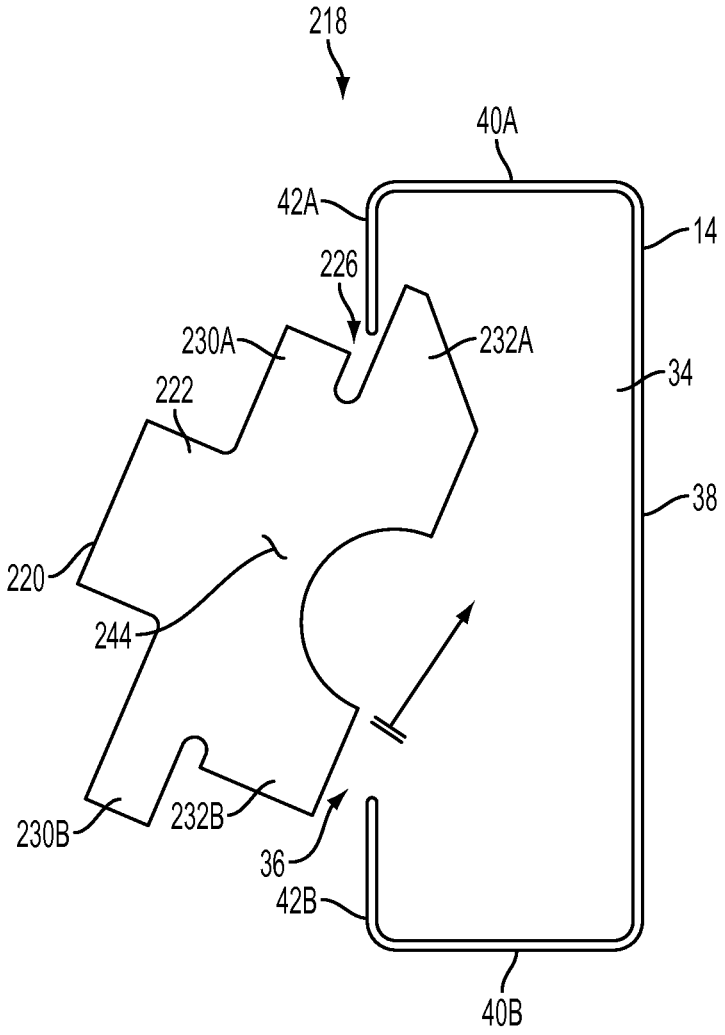
FIG. 11 shows an end view of the assembly of the bracket portion of FIG. 10 with a channel structure in forming the further embodiment of the fence assembly.
Figure 12:
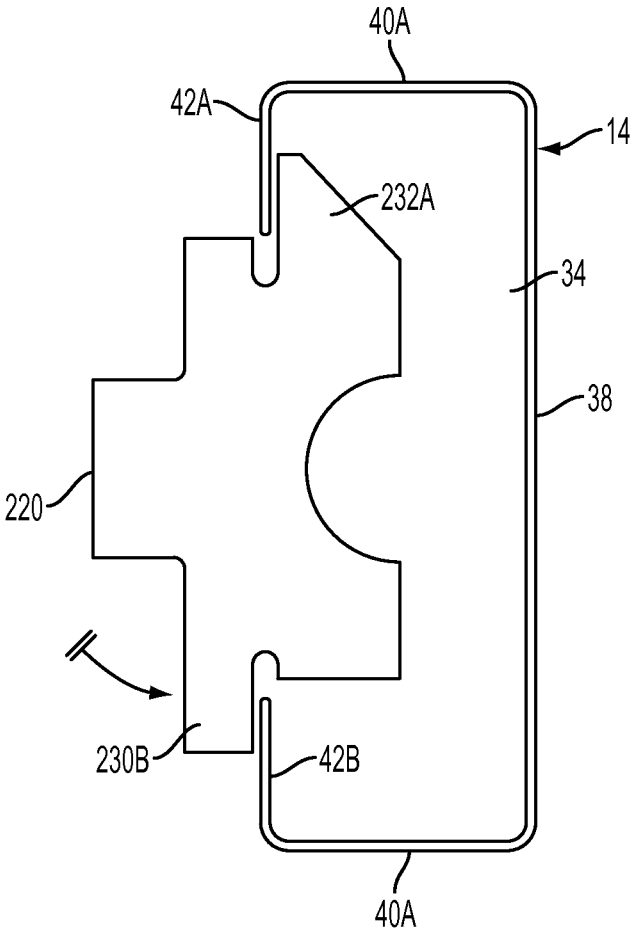
FIG. 12 shows an end view of a further step in the assembly of the bracket portion of FIG. 10 with a channel structure in forming the further embodiment of the fence assembly.
Figure 13:
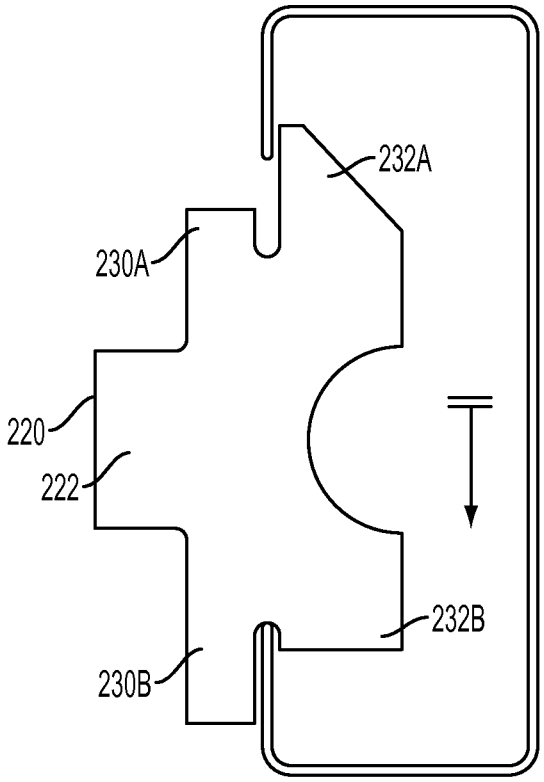
FIG. 13 shows an end view of a still further step in the assembly of the bracket portion of FIG. 10 with a channel structure.

In FIGS. 10-13, there is shown a further embodiment of a bracket 218 as contemplated by the present disclosure in forming a fence assembly. In FIG. 10, the bracket 218 includes a front or body portion 220, two opposing extensions or arms 222 and two engagement ends 224. The arms 222 as shown directly connect to the engagement ends 224 in the manner contemplated by the bracket 18 of FIG. 2. It should be understood that offset elements and spacer tabs of the type shown in FIG. 7 may also be provided with the features of the present bracket embodiment. The engagement structures of the engagement ends 224 of bracket 218 are different from those found in the prior discussed embodiments. The engagement ends 224 of bracket 218 are formed to permit the front assembly of the bracket 218 with the rail 14 as shown in FIGS. 11-13.

As shown in the side view of FIG. 11, the engagement ends 224 of the bracket 218 include two aligned engagement slots 226, 228 separated by a central portion 244. The slots are formed for receipt of the front face members 42 of the elongated rail 14 (see FIGS. 12 and 13). Forward of the slots 226, 228 are provided front tabs 230A and 230B having a desired form for purposes of the front mounting of bracket 218 on the rail 14. Generally, the upper front tab 230A is relatively shorter that the lower front tab 230B. Rearward of the slots 226, 228 are provided rear tabs 232A and 232B, again, having a desired form for purposes of the front mounting of bracket 218 on the rail 14. Generally, the upper rear tab 232A is longer than the lower rear tab 232B. In addition, the upper front tab 230A is shorter than the adjacent rear tab 232A. Similarly, the lower rear tab 232B is shorter than the adjacent front tab 230B.

As shown in FIG. 11, the bracket 218 is inserted into the channel 36 between the front face members 42A, 42B at an upward angle, as shown by the arrow. The upper face member 42A is inserted into the upper slot 226, with the shortened front tab 230A providing clearance sufficient for the angled insertion of the bracket 218 into the channel 34, without interference between the tab 230A and the front face member 42A. The lower rear tab 232B is also permitted to move past the lower face member 42B of the rail 14. In addition, the angled or notched surface of tab 232A may be provided for clearance with the rear wall 38 of the rail 14 for the insertion of the tab 232A. In FIG. 12, the bracket 218 is rotated into the channel 36, as shown by the arrow. The clearance created by the size or form of the lower rear tab 232B permits the lower end of the engagement structure to move past the lower front face member 42B of the rail 14 and into the interior hollow 34. The lower rear tab 232B may be provided with an angled edge or notch (similar to the angle shown on tab 232A) to assist in creating clearance as the bracket is rotated into the channel 36. The front tab members 230A and 230B are brought into engagement with the front surfaces of members 42A and 42B. In FIG. 13, the bracket 218 is moved downwardly, as shown by the provided arrow, to complete the engagement of the bracket 218 on the rail 14. The upper rear tab 232A is positioned behind the upper front face member 40A, as is the lower rear tab 232B. Further, the lower front tab 230B is engaged with the lower face member 42B of the rail 14. Once the fence slat (16) is inserted into the retaining gap 246, outward rotation of the bracket 218 will be retarded. However, if it is necessary to remove a slat (16) the bracket 218 may be manipulated for removal and subsequent replacement without the need to remove adjacent slats or brackets.

The brackets 18, 118 and 218 as shown are preferably formed out of galvanized steel. The bracket structure may be stamped from a planer sheet of desired thickness, with the stamped part bent to form the extensions and, if desired, the offsets and tabs. Preferably, the rails are similarly formed from galvanized steel. Alternatively, aluminum may be used to form either the brackets or rails. The slats and posts may be formed from aluminum, plastic, wood, etc. The posts are shown as having a square transverse profile. Round posts formed of aluminum or steel may be used, with other profiles not being excluded. An existing fence may be retrofit with the rail, bracket and slat structure, utilizing the existing posts and securing the rails thereto. The length and height of the fence sections may further be modified to meet the functional and aesthetic needs of the fence owner.

Various bracket forms and attachment means may be used to secure the rails to the posts. Predrilled holes and/or slots may be provided in the back wall (38) and/or the sidewalls (40) in the rails (14). The holes in the back wall of the rail would serve to reduce installation time, as the installer would already have holes/slots to put screws through to attach the rails to the posts. The holes in the top/bottom sidewalls may serve for water drainage or may be used for the attachment of additional structures on the top rail. Screws or other fasteners may also be used to fix the slats to the brackets. The fixed slats may then be retained at a desired position for maintaining a uniform position and/or a space between the bottom edge of the slats and the ground surface. Spacer members (not shown) may be provided between brackets to create a fixed opening between neighboring slats; for example, to create a picket fence formation.

If desired, the brackets and/or the rails may be painted or coated to create a more aesthetic appearance. Other design variations may include differences in the height of the brackets, such that different bracket rows have a different appearance. In addition, the rails and brackets may be modified to permit angling, creating a wave or curved pattern across the fence sections.

The present invention has been described and illustrated with respect to one or more exemplary embodiments. It should be understood by those skilled in the art from the foregoing that various other changes, omissions and additions may be made therein, without departing from the spirit and scope of the present invention, with the scope of the invention being described by the foregoing claims.

What is claimed is:

1. A fence assembly comprising:

a plurality of posts;

a plurality of elongated rails, the rails being supported by at least one of the plurality of posts, and the rails having a hollow interior defined by a back wall, a pair of opposing side walls extending from and along the back wall, a pair of front face members, the front face members extending along and projecting from a respective one of the side walls, the front face members extending toward each other and defining a channel there between, the channel extending continuously along the length of the rail and communicating with the hollow interior, and open ends communicating with the hollow interior;

a plurality of fence slats, each fence slat having a defined length, width and height;

a plurality of brackets, each bracket comprising a planar body portion, a pair of opposing body extensions projecting transversely from the body portion, and engagement ends positioned on the body extensions, the engagement ends each extending transversely with respect to the body portion and the body extensions, the engagement ends forming an engagement structure, the engagement structure having upper and lower slots, upper and lower rear tabs for insertion into the interior hollow of the rails from one end of the rails and upper and lower front tabs provided opposite the respective upper and lower slots from and having substantially the same transverse extension from the body extensions as the respective upper and lower rear tabs, the engagement structure formed to slidably engage the front face members of the rails, with the front face members positioned within the upper and lower slots, the rear tabs positioned within the hollow interior of the rail and engaging a rear side of the front face members of the rails and the front tabs positioned forward of and engaging the front face members of the rail;

wherein a plurality of brackets is secured to at least one rail, the body extensions of the plurality of brackets space their respective body portions from the front face members of the at least one rail to each define a retaining slot having a length and width sufficient to receive at least one fence slat of a plurality of fence slats and to retain and support the at least one fence slat on the rail between the front face members of the at least one rail and the body portion of the bracket, and wherein the at least one rail is attached to one or more of a plurality of posts to form, along with the plurality of brackets and plurality of fence slats, a fencing section.

2. The fence assembly of claim 1, wherein at least two rails are provided in parallel, each rail having a plurality of aligned brackets, and wherein at least two of the aligned brackets support at least one fence slat, and wherein the combination forms the fence section.

3. The fence assembly of claim 2, wherein a plurality of fence sections is provided and wherein the rails for adjacent fence section are aligned.

4. The fence assembly of claim 1, wherein the rails have a C-shaped transverse profile.

5. The fence assembly of claim 1, wherein the brackets have a U-shaped transverse profile, with the engagement ends formed on the projected body extensions.

6. A fence assembly comprising:

a plurality of posts, a plurality of elongated the rails being supported by at least one of the plurality of posts, and the rails having a hollow interior defined by a back wall, a pair of opposing walls extending from and along the back wall, and a pair of face members, the front face members extending along and projecting from a respective one of the side walls, the front face members extending toward each other and defining a channel there between, the channel extending continuously along the length of the rail and communicating with the hollow interior;

a plurality of fence slats, each having a defined length, width and height;

a plurality of brackets, each bracket comprising a planar body portion, a pair of opposing body extensions projecting transversely from the body portion, and engagement ends positioned on the body extensions, the engagement ends each extending transversely with respect to the body portion and the body extensions, the engagement ends forming an engagement structure, the engagement structure having upper and lower slots, upper and lower rear tabs for insertion through the channel and into the interior hollow of the rails and upper and lower front tabs provided opposite the respective upper and lower slots from the respective upper and lower rear tabs, the engagement structure formed to secure the brackets to the front face members of the rails, with the front face members positioned within the upper and lower slots, the rear tabs positioned within the hollow interior of the rail and the front tabs positioned forward of the front face members of the rail;

wherein a plurality of brackets is secured to at least one rail, the body extensions of the plurality of brackets space their respective body portions from the front face members of the at least one rail to each define a retaining slot having a length and width sufficient to receive at least one fence slat of a plurality of fence slats and to retain and support the at least one fence slat on the rail, and wherein the rail is attached to one or more of a plurality of posts to form, along with the plurality of brackets and plurality of fence slats, a fencing section, and wherein a subset of the plurality of brackets further comprise offset members connected to the body extensions and extending inwardly, and spacer tabs connecting the offset members to the engagement ends.

7. A fence assembly comprising:

a plurality of first brackets, each bracket comprising a planar body portion, a pair of opposing body extensions projecting transversely with respect to the body portion, and engagement ends positioned on the body extensions and spaced from the body, the engagement ends each having an engagement structure projecting in both an upper and lower direction from the body extensions and transversely with respect to the body portion, the engagement structure having upper and lower slots, upper and lower rear tabs, and upper and lower front tabs provided opposite the respective upper and lower slots from the respective upper and lower rear tabs, at least one elongated support bar, the support bar having a hollow interior and defining an open channel continuously along a front face of the support bar, either the upper or lower rear tabs on the engagement ends of the first brackets having a transverse extension that is relatively less than the extension of upper or lower front tabs corresponding to the either of the upper or lower rear tabs, the other of the upper or lower rear tabs on the engagement ends of the first brackets having a transverse extension that is relatively greater than the extension of the upper or lower front tabs corresponding to the other of the upper or lower rear tabs, the differing extension providing clearance during insertion of the rear tabs into the open channel and for secured engagement by the upper and lower rear tabs with the front face of the support bar on the hollow interior side of the front face of the support bar and by the front tabs corresponding to the either of the upper or lower rear tabs on an exterior of the front face of the support bar, with the engagement ends positioned on opposite sides of the open channel, a plurality of support posts, the at least one support bar secured to one or more of the plurality of posts, and a plurality of fence slats, wherein the plurality of first brackets are engaged within the channel and slidably movable alone the support bar, the engagement structure formed to secure the brackets to the front face of the support bar, with the rear tabs inserted through the channel and positioned within the hollow interior of the support bar and the front tabs positioned forward of and engaged with the front face of the support bar, wherein the fence slats are fit between one of the first brackets and the support bar, and wherein each of the plurality of first brackets overlaps and retains at least one slat on the front face of the support bar, with the body portion one first bracket on one side thereof and the support bar on an opposite side thereof.

8. The fence assembly of claim 7, wherein at least one of the upper or lower rear tabs includes an angled edge portion.

9. A fence assembly as in claim 7, wherein the support bar includes a "C" shaped profile and the open channel extends along the length of the bar.

10. A fence assembly as in claim 7, wherein the first brackets are generally U-shaped.

11. A fence assembly as in claim 7, wherein the first brackets are positioned side-by-side along the length of the support bar.

12. A fence assembly as in claim 7, wherein multiple first brackets are inserted into the channel and are positioned adjacent one another along the length of the support bar.

13. A fence assembly as in claim 7, wherein at least two support bars are provided in parallel, each having a plurality of aligned first brackets, and wherein at least two of the aligned first brackets support one fence slat, wherein the combination forms a fence section.

14. A fence assembly as in claim 13, wherein a plurality of fence sections are provided, the support bars for each fence section being aligned and attached at respective ends thereof.

15. A fence assembly comprising:

a plurality of first brackets each bracket comprising a planar body portion, a pair of opposing body extension projecting transversely with respect to the body, and engagement ends positioned on the body extensions and spaced from the body, the engagement ends each having an engagement structure projecting in both an upper and lower direction from the body extensions and transversely with respect to the body portion, the engagement structure having upper and lower slots, upper and lower rear tabs, and upper and lower front tabs provided opposite the respective upper and lower slots from the respective upper and lower rear tabs, at least one elongated support bar, the support bar having a hollow interior and defining an open channel continuously along a front face of the support bar, a plurality of support posts, the at least one support bar secured to one or more of the plurality of posts, and a plurality of fence slats, wherein the plurality of first brackets are slidably engaged within the channel on the support bar, the engagement structure formed to secure the brackets to the front face members of the support bar, with the rear tabs inserted through the channel and positioned within the hollow interior of the support bar and the front tabs positioned forward of the front face of the support bar, wherein the fence slats are fit between one of the first brackets and the support bar, and wherein each of the plurality of first brackets overlaps and retains at least one slat on the front face of the support bar, with the body portion of the one first bracket on one side thereof and the support bar on an opposite side thereof, and a plurality of second brackets for retaining a plurality of second slats, the plurality of second brackets each comprising spacer members and offset members connected adjacent the body extensions for retaining the plurality of second slats at a distance from the at least one support bar greater than the distance of the slats retained by the plurality of first brackets.

16. A fence assembly as in claim 15, wherein the plurality of first brackets and the plurality of second brackets are alternated along the length of the at least one support bar and wherein the second slats retained by the second brackets overlap the adjacent first slats retained by the alternating first brackets.

* * * * *